US005868218A

United States Patent [19]

Lawson

[11] Patent Number: 5,868,218

[45] Date of Patent: Feb. 9, 1999

[54] MOBILE LIFT ASSEMBLY

[75] Inventor: George Leslie Lawson, Calgary, Canada

[73] Assignee: Mobilift Inc., Calgary, Canada

[21] Appl. No.: 864,188

[22] Filed: May 28, 1997

[51] Int. Cl.[6] ..... B66F 11/04

[52] U.S. Cl. ..... 182/69.6; 182/2.2; 182/2.3; 182/2.7

[58] Field of Search ..... 182/69.6, 69.4, 182/2.3, 2.7, 2.11, 65.1, 2.2

[56] References Cited

U.S. PATENT DOCUMENTS

| | | | |
|---|---|---|---|
| 2,647,022 | 7/1953 | Smid | 182/69.4 |
| 2,674,500 | 4/1954 | Hukari | 182/2.7 |
| 2,753,224 | 7/1956 | Troche | 182/69.4 |
| 2,954,092 | 9/1960 | Thornton-Trump . | |
| 2,998,861 | 9/1961 | Hotchkiss . | |
| 3,127,952 | 4/1964 | Baerg . | |
| 3,301,346 | 1/1967 | Verrell | 182/2.3 |
| 3,709,322 | 1/1973 | Mitchell . | |
| 4,116,304 | 9/1978 | Durnell . | |
| 4,757,875 | 7/1988 | Hade . | |
| 5,269,393 | 12/1993 | Luscombe | 182/2.3 |

FOREIGN PATENT DOCUMENTS

| | | | |
|---|---|---|---|
| 997686 | 9/1976 | Canada . | |
| 2055864 | 7/1995 | Canada . | |
| 556661 | 8/1993 | European Pat. Off. | 182/69.4 |
| 2201138 | 8/1988 | United Kingdom | 182/2.7 |

*Primary Examiner*—Alvin C. Chin-Shue
*Attorney, Agent, or Firm*—George A. Seaby

[57] ABSTRACT

A lift assembly includes a work platform pivotally mounted on the end of a boom for rotation through 270° around a vertical post on the outer end of the boom. Rotation of the platform is effected manually by an operator on the platform, who also controls the location of the platform with respect to a truck or trailer carrying the lift assembly. A foot operated latch mechanism on the platform retains the platform in one position on the outer end of the boom.

5 Claims, 5 Drawing Sheets

MOBILE LIFT ASSEMBLY

BACKGROUND OF THE INVENTION

1. Field of the Invention

This invention relates to a lift assembly, and in particular to an assembly for elevating a work platform.

2. Discussion of the Prior Art

The lift assembly described herein is designed for use on a truck or trailer. The prior art contains many examples of vehicles carrying aerial work platforms. In general, existing apparatuses include a turntable carrying a boom on which a work platform is mounted. The following are examples of patents describing arrangements of the type in question.

U.S. Pat. No. 2,954,092, which issued to Thornton-Trump on Sep. 27, 1960 discloses a mobile apparatus including a swingable boom supporting a work platform, which moves vertically and horizontally from the ground to an elevated position.

U.S. Pat. No. 2,998,861, which issued to Hotchkiss on Sep. 5, 1961 discloses an orchard crane, which is self-propelled and which carries a platform on a boom having a levelling arm for maintaining the platform in a horizontal plane. The platform is mounted on a turntable, which is rotated by cables.

U.S. Pat. No. 3,127,952, which issued to Baerg on Apr. 7, 1964 describes a mobile work platform designed to position a worker close to trees in an orchard. The platform carrying the worker is elevated and rotatable on a main support in combination with a parallelogram lift beam assembly, which maintains the platform in a substantially horizontal position during movement. The main control system of the apparatus is hydraulically actuated.

U.S. Pat. No. 4,116,304, which issued to Durnell on Sep. 26, 1978 discloses an aerial personnel lift including a bucket, the position of which is automatically controlled. In the Durnell arrangement, a telescopic boom is maintained in a vertical position using an electric motor and mercury sensor switches.

U.S. Pat. No. 4,757,875, which issued to Hade et al on Jul. 19, 1988, describes a self-propelled aerial work station including a turntable on a vehicle. A parallelogram linkage connecting the turntable to a boom supports a work platform. When the platform is being raised or while in the elevated position, the structure is within the wheel base of the vehicle to provide stability and zero tailspin.

While the prior structures described above may be generally acceptable, the apparatuses are relatively complex and consequently expensive to manufacture and maintain. The assemblies also lack positive control of the work platform, the location thereof, and maneuverability.

GENERAL DESCRIPTION OF THE INVENTION

An object of the present invention is to provide a lift assembly, which while relatively simple in terms of structure, does not sacrifice support strength or reducing extensibility or load carrying capacities.

Another object of the invention is to provide a lift assembly, which can readily be mounted in a small space such as a box of a truck or a self-propelled or towed trailer.

Yet another object of the invention is to provide a lift apparatus in which a work platform can be positioned both vertically and horizontally by an operator on the platform and, once the platform has been positioned, the platform can be manually rotated by the operator.

Accordingly, the present invention relates to a lift means assembly comprising base means for mounting the assembly on a vehicle; boom means having one end rotatably mounted on said base means for rotation around vertical and horizontal axes; first drive means for rotating said one end of boom means around said vertical and horizontal axes; post means on a second end of said boom means remote from said base means; work platform means pivotally mounted on said post means for rotation around a vertical axis of said post means through at least 270°; manually operable second drive means on said platform means for rotating said platform means around said vertical axis of said post means; and latch means on said platform means for releasably locking said platform means in one of a plurality of positions.

BRIEF DESCRIPTION OF THE DRAWINGS

The invention is described below in great detail with reference to the accompanying drawings, which illustrate a preferred embodiment of the invention, and wherein.

DESCRIPTION OF THE PREFERRED EMBODIMENT

It will be noted that parts have been omitted from most figures of the drawings. This was done for the sake of simplicity and to facilitate an understanding of the invention.

Figure 1:
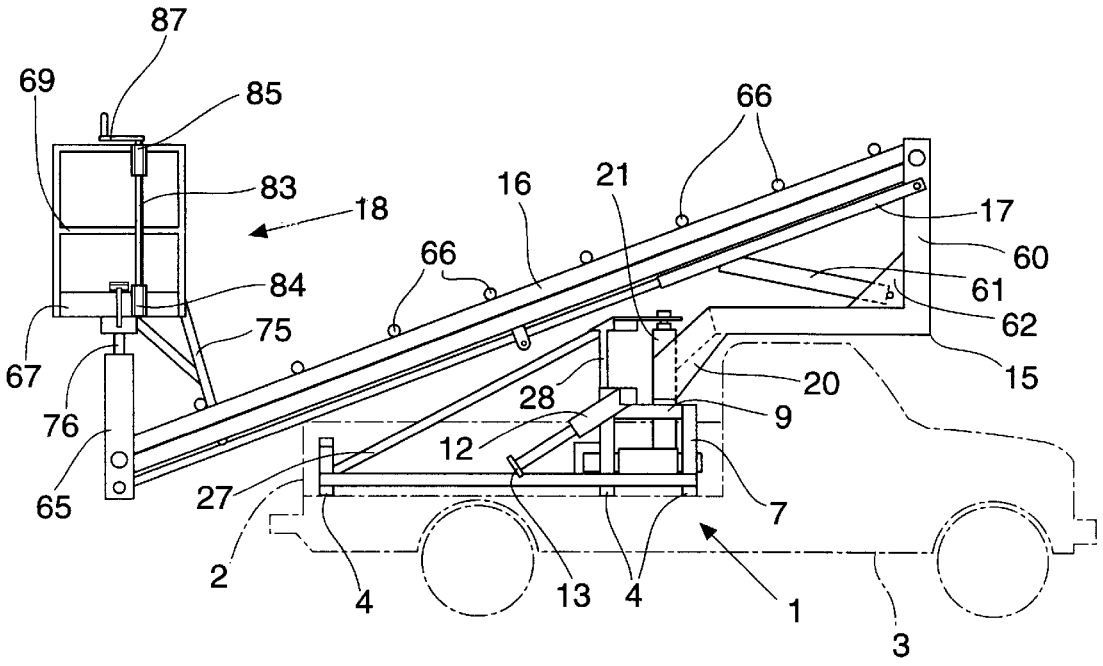
FIG. 1 is a schematic side view of a lift assembly in accordance with the invention in a non-use transport position.
Figure 2:
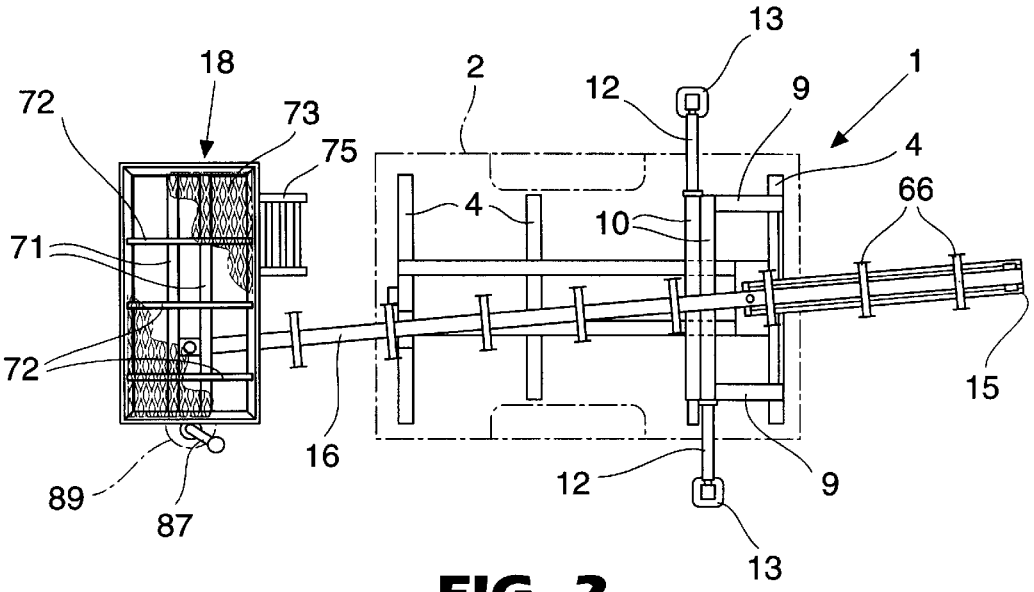
FIG. 2 is a schematic top view of the assembly of FIG. 1.
Figure 5:
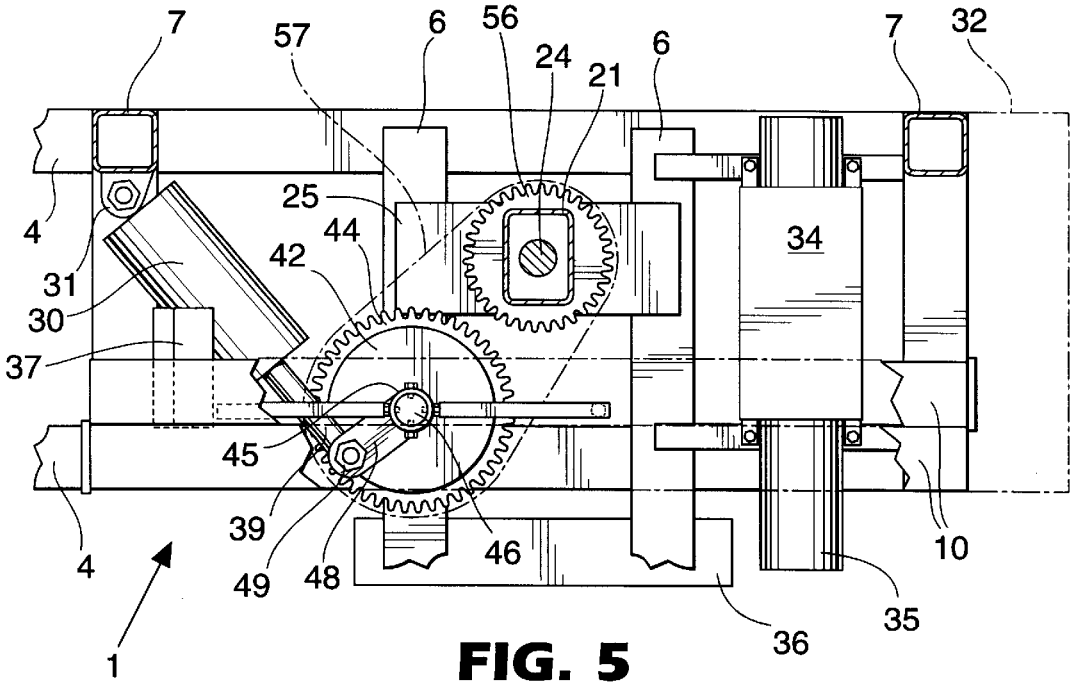
FIG. 5 is a top view of a portion of a base and drive used in the assembly of FIGS. 1 to 4.
Figure 6:
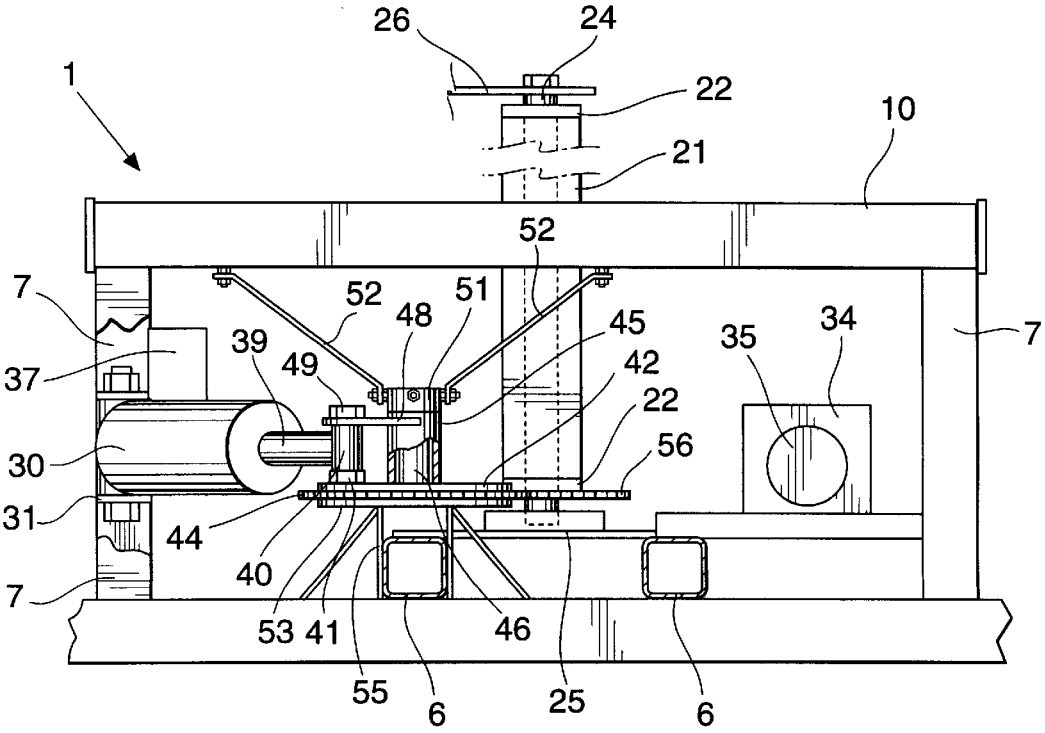
FIG. 6 is a party sectioned end view of the base and drive of FIGS. 5.

With reference to FIGS. 1 and 2, the preferred embodiment of the lift assembly includes a base defined by a skeletal support frame generally indicated at 1, which is mounted in a box 2 or on the bed of a truck 3 shown in phantom outline. The use of the support frame 1 permits quick and easy removal of the assembly from a vehicle. As best shown in FIGS. 2, 5 and 6, the frame 1 includes crossbars 4 extending transversely of the bottom of the box 2 of the truck 3, and a pair of bars 6 extending longitudinally of the truck box 2 and interconnecting the crossbars 4. Posts 7 extend upwardly from the bars 6. The posts 7 are interconnected by top bars 9 and crossbars 10. The tubular crossbars 10 at the rear end of the front portion of the frame 1 telescopically support outriggers 12 carrying feet 13 for stabilizing the assembly during use.

Figure 3:
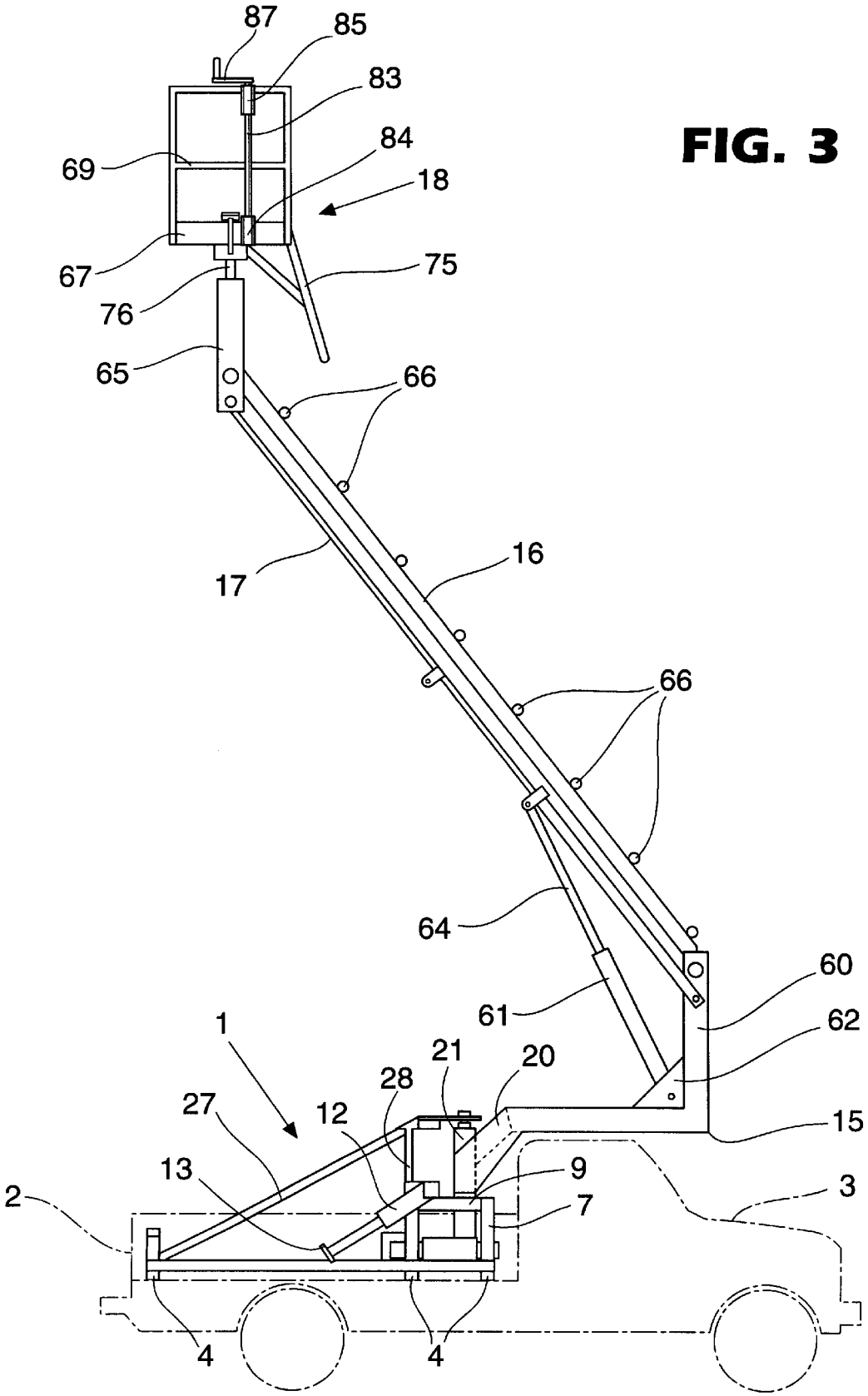
FIG. 3 is a schematic side view of the assembly of FIGS. 1 and 2 showing a work platform in the elevated, use position.

As best shown in FIGS. 1 and 3, the front portion of the frame 1 carries a gooseneck 15, a boom 16, a stabilizing beam 17 and a platform generally indicated at 18. The inner end 20 of the gooseneck 15 is connected to a square cross section sleeve 21 which is rotatably mounted in bearings 22 on a post or axle 24. The post 24 extends between a base plate 25 and a top plate 26 of the frame 1. The plate 26 is mounted on the top of a tripod arrangement defined by a diagonal strut 27 extending upwardly and forwardly from the rear crossbar 4 of the frame 1 and a pair of diagonal braces 28 extending upwardly and inwardly form the rearmost top crossbar 10.

The sleeve 21 is rotated by a drive mechanism mounted in the frame 1. The drive mechanism includes a hydraulic cylinder 30 pivotally mounted in a clevis 31 on one post 7 of the frame 1. The cylinder 30 receives fluid from a reservoir 32 via a pump 34 driven by an electric motor 35. Batteries 36 (FIG. 5) provide power to the motor 35. The motor 35 is actuated by a switch 37 mounted on a post 7 of the frame 1. The switch 37 can also be mounted on the platform 18 for actuation by an operator. The outer end of a piston rod 39 extending out of the cylinder 30 is connected to a sleeve 40 rotatably mounted on a bolt 41. The bolt 41 is connected to a disc 42 mounted on a large sprocket 44. The disc 42 and the sprocket 44 are welded to the bottom end of a sleeve 45 rotatably mounted on a post 46. An arm 48 extending outwardly from the top end of the sleeve 45 receives the top end of the bolt 41. A nut 49 retains the bolt 41 in the sleeve 40 and the arm 48. A head 51 (FIG. 6) on the post 46 is connected to the top of the frame 1 by four diagonal braces 52 (two shown). The sprocket 44 rotates on a bottom disc 53 mounted on a stand 55. The disc 53 is connected to the bottom end of the post 46 which extends through holes (not shown) in the centers of the top disc 42. Because the sleeve 40 and the bolt 41 are eccentrically mounted on the disc 42 and the sprocket 44, longitudinal movement of the piston rod 39 results in rotation of sleeve 45 on the post 46, the disc 42 and the sprocket 44 attached thereto.

The large sprocket 44 is connected to a smaller sprocket 56 on the bottom end of the sleeve 21 by a chain 57, whereby rotation of the sprocket 44 results in a corresponding rotation of the sleeve 21 and consequently of the gooseneck 15, the boom 16, the stabilizing beam 17 and the platform 18 around the vertical, longitudinal axis of the post 24.

As best shown in FIGS. 1 and 3, the boom 16 and the stabilizing beam 17 are rotated around horizontal axes at the top of a vertical arm 60 of the gooseneck 15 by a hydraulic cylinder 61. The stabilizer beam 17 provides lateral stability to the boom 16, and helps in maintaining the platform 18 in the vertical position. One end of the cylinder 61 is pivotally mounted to a triangular bracket 62 on the gooseneck 15. A piston rod 64 extending out of the free end of the cylinder 61 is pivotally connected to the beam 17 for rotating the boom 16 and the beam 17 to elevate or lower the platform 18.

Figure 4:
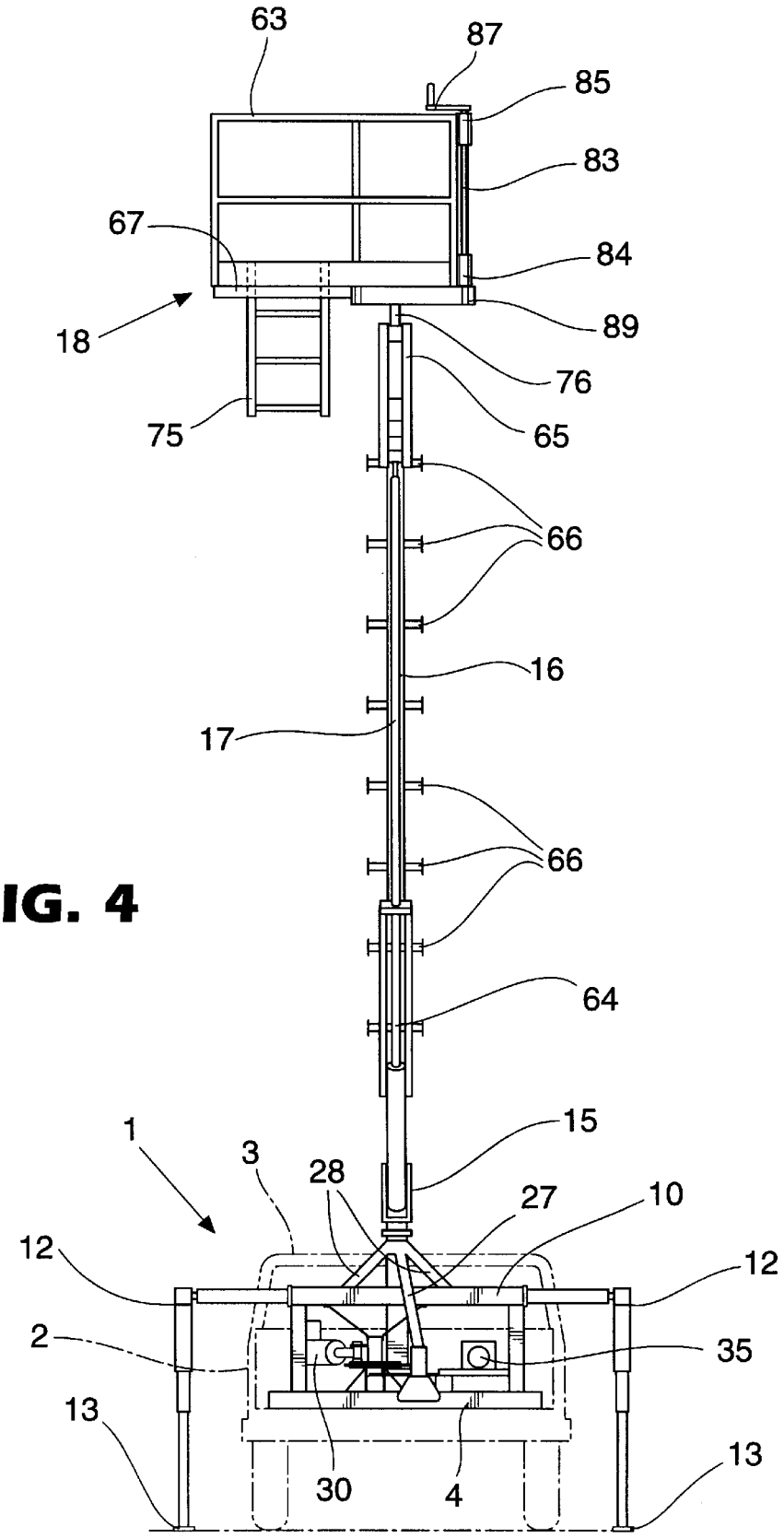
FIG. 4 is a rear view of the assembly of FIGS. 1 to 3, with the work platform in the raised or elevated position.

A plurality of rods defining steps 66 extend transversely of the top of the boom 16 facilitating access to the platform 18 or escape therefrom if the platform is jammed in the elevated position. The platform 18 is mounted on a post 65 connected to the outer free ends of the boom 16 and the beam 17 for vertical movement between a rest position (FIGS. 1 and 2) and an elevated position (FIGS. 3 and 4). The platform 18 is defined by a base 67, a pair of side walls 68 (one shown), one end wall 69 and an open end which is normally closed by a gate (not shown). The base is 67 of the platform 18 includes longitudinally extending bars 71 (FIG. 2) and crossbars 72 supporting a metal mesh floor 73. A ladder 75 facilitates access to the platform 18.

Figure 7:
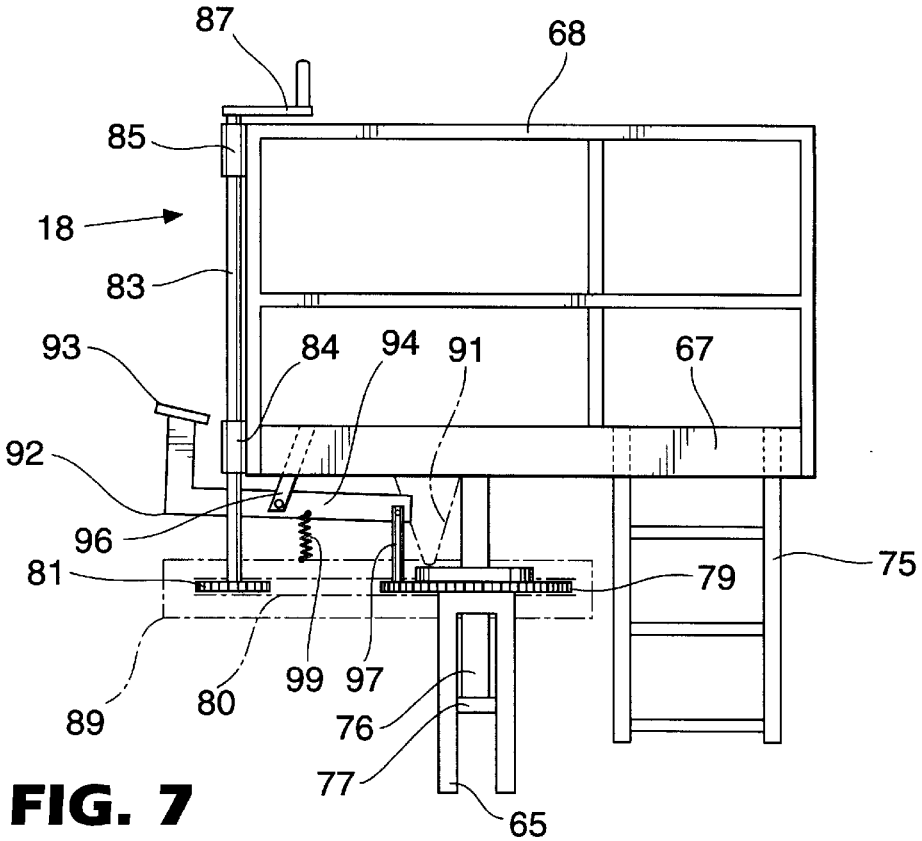
FIG. 7 is a side view of a work platform used in the assembly of FIGS. 1 to 4 and a mechanism for manually rotating the platform.
Figure 8:
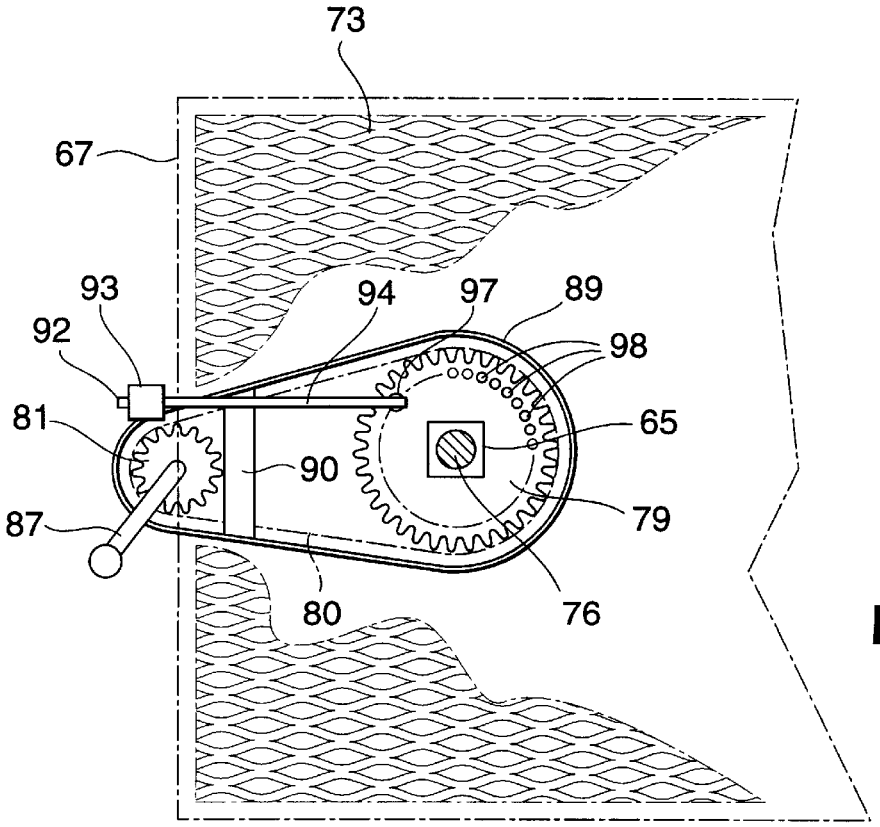
FIG. 8 is a plan view of the platform rotating mechanism of FIG. 7.

The platform can be manually rotated around the longitudinal axis of the post 65. For such purpose, the base 67 of the platform 18 is connected to a shaft 76, which rotatably mounted in bearings 77 in the top end of the post 65. The shaft 76 extends upwardly through the center of a large sprocket 79 fixedly mounted on the top end of the post 65. An endless chain 80 connects the sprocket 79 to a smaller sprocket 81 mounted on the bottom end of a shaft 83. The shaft 83 is rotatably mounted in sleeves 84 and 85 connected to the base 67 and the closed end 69, respectively of the platform 18. A handle 87 on the top end of the shaft 83 permits manual rotation of the shaft 83. Rotation of the shaft 83 results in rotation of the sprockets 79 and 81. Because the sprocket 79 is fixed, the sprocket 81 and consequently the platform 18 are walked around the post 65. As best shown in FIGS. 7 and 8, the platform 18 is eccentrically mounted on the post 65, and can be rotated around the longitudinal axis of the post 65 through 270°.

A generally drop-shaped shroud 89 surrounds the sprockets 79 and 81 and the chain 80. The shroud 89 is reinforced by a crossbar 90 near the narrow end thereof. The shroud 89 is connected to the base 67 of the platform 18 by arms 91 (one shown - FIG. 7), so that the shroud rotates with the platform 18.

The platform 18 is locked in one position by a latch mechanism including a generally L-shaped lever 92, which includes a foot pedal 93 on the top end of the vertical arm thereof for actuation by an operator on the platform. The horizontal arm 94 of the lever 92 is pivotally connected to the base 67 of the platform 18 by a bracket 96. A pin 97 on the inner end of the horizontal arm 94 of the lever 92 is biased into one of a plurality of holes 98 defining a circular row in the large sprocket 79 by a helical spring 99 extending between the base 67 of the platform 18 and the shroud 89. Because the sprocket 79 is fixed to the top end of the post 65, when the pin 97 is in one of the holes 98, the platform 18 cannot be rotated on the post 65. When the outer end of the lever 92 is depressed, the pin 97 escapes from the hole 98 and the platform can be rotated. When the platform is near the desired position, the lever 92 is released and the spring 99 causes the pin 97 to enter the next hole which it encounters in the sprocket 79.

I claim:

1. A lift assembly comprising:

(a) base means for mounting the assembly on a vehicle;

(b) boom means having one end rotatably mounted on said base means for rotation around vertical and horizontal axes; (c) first drive means for rotating said one end of boom means around said vertical and horizontal axes;

(d) post means on a second end of said boom means remote from said base means;

(e) work platform means pivotally mounted on said post means for rotation around a vertical axis of said post means through at least 270°;

(f) manually operable second drive means on said platform means for rotating said platform means around said vertical axis of said post means, said second drive means including:

(i) first shaft means rotatably mounted in a top end of said post means and carrying said platform means, (ii) first sprocket means fixed on said post means, (iii) second shaft means rotatable on one end of said platform means, (iv) second sprocket means on said second shaft means, and (v) chain means extending around said first and second sprocket means, whereby manual rotation of said second shaft means results in a corresponding rotation of said platform means around the axis of said first shaft means;

(g) latch means on said platform means for releasably locking said platform means in one of a plurality of positions, said latch means including (i) a plurality of holes defining a circular row in said first sprocket means, (ii) lever means pivotally connected to said platform means for pedal actuation from said platform means, and (iii) pin means on one end of said lever means for releasably engaging said first sprocket means by extending into one of said plurality of holes.

2. The lift assembly of claim 1, wherein said base means includes skeletal frame means for mounting on a vehicle, said frame means carrying said first drive means, and said first drive means including sleeve means rotatably mounted in said frame means; gooseneck means connecting said sleeve means to said one end of said boom means; and first hydraulic cylinder means for rotating said sleeve means and consequently said boom means around said vertical axis.

3. The lift assembly of claim 2, wherein said first drive means includes second hydraulic cylinder means extending between said gooseneck means and said boom means for rotating said boom means around said horizontal axis.

4. The lift assembly of claim 1, wherein said latch means includes spring means biasing said lever means to a position in which said pin means engages said first sprocket means, pedal actuation of said lever means releasing said pin means from said first sprocket means.

5. The lift assembly of claim 4, including foot pedal means on a second end of said lever means.

* * * * *